United States Patent [19]

Shaffer

[11] 4,422,009

[45] Dec. 20, 1983

[54] TUNGSTEN-HALOGEN INCANDESCENT LAMP CONTAINING ADDITIVE TO REDUCE FILAMENT SAG

[75] Inventor: John W. Shaffer, Williamsport, Pa.

[73] Assignee: GTE Products Corporation, Stamford, Conn.

[21] Appl. No.: 372,513

[22] Filed: Apr. 28, 1982

[51] Int. Cl.[3] ..... H01K 1/62

[52] U.S. Cl. ..... 313/579; 313/271

[58] Field of Search ..... 313/579, 637, 642, 271

[56] References Cited

FOREIGN PATENT DOCUMENTS 54-39973 3/1979 Japan ..... 313/642

*Primary Examiner*—David K. Moore

*Assistant Examiner*—K. Wieder

*Attorney, Agent, or Firm*—William H. McNeill

[57] ABSTRACT

Filament sag in tungsten-halogen lamps is significantly reduced by including within the envelope an additive selected from the group of bismuth, antimony and tellurium and combinations thereof.

2 Claims, 2 Drawing Figures

TUNGSTEN-HALOGEN INCANDESCENT LAMP CONTAINING ADDITIVE TO REDUCE FILAMENT SAG

TECHNICAL FIELD

This invention relates to incandescent lamps and more particularly to tungsten-halogen incandescent lamps. Still more particularly it relates to lamps of the latter variety having means incorporated therewith to reduce filament sagging, thus allowing long life and the ability to be lighted in either a vertical or horizontal mode.

BACKGROUND OF THE INVENTION

The majority of incandescent lamps today use a filament made from tungsten wire which can be of the single or coiled coil design. When initially energized to incandescence, the filament will both metallurgically recrystalize and physically sag under gravitational attraction.

Coiled coil filaments sag more than single coils and fine wire sags more than heavy wire.

In the vertical position sag is characterized by a collapsing of turns with open turns at the top and compression at the bottom. Sag in the horizontal position is characterized by the formation of one or more catenaries depending on the number of filament support wires.

The preliminary sag in tungsten filaments has never been completely eliminated. However, it can be significantly reduced by employing a controlled heating process at the time of initial lightup. Two different processes for doing this are now in common use and are briefly described as follows.

1. Pre-stabilizing is a process used mainly on coiled coil filaments for halogen lamps. It involves raising the coil temperature above 2400° C. in vacuum prior to removing the primary mandrel and while the secondary coiling is mounted on a threaded rod. The result is a brittle coil which requires hand mounting. This, plus the pre-stabilizing process make for a very expensive coil. However, preliminary sag at initial coil lightup is minimal.

2. Flashing is an alternate method of stabilizing the filament. It is done after the coil is mounted in the lamp and can be performed either before or after tipoff. Since the filament as received is not brittle, it does not require hand mounting and can therefore be mounted inexpensively via high speed automatic equipment. Initial lightup under these conditions results in more preliminary sag than on pre-stabilized coils.

Unfortunately, the filament in an incandescent lamp will continue to sag during subsequent lamp operation in spite of pre-stabilizing or flashing. This is generally attributed to a slippage at the grain boundaries. The condition is known to be aggravated by the presence of oxygen in the vapor state. This accounts for a higher degree of sag in halogen lamps because the halogen regenerative cycle retains a higher percentage of oxygen in the vapor state than there is in a non-halogen incandescent lamp. Generally, the sag in non-halogen incandescent lamps is not severe because most of the residual oxygen is tied up on the bulb wall as tungsten-oxide, a colorless solid condensate. Thus, a sufficient quantity of oxygen is not available in the vapor state to promote sag.

However, in halogen lamps secondary sag can be a serious problem due to the fact that any oxides present can be reduced by the halogen additive (HBr in this case) which promotes the presence of free oxygen in the vapor state.

As was the case with preliminary sag, fine wire filaments of the coiled coil configuration are especially susceptible to severe secondary sag in a halogen atmosphere. Also, chemical corrosion of the wire in the cooler sections of the filament results in a significant reduction in life as caused by thinning and premature arcing. This is more pronounced in fine wire than it is in heavy wire.

These problems become even more aggravated in the case of a tungsten-halogen lamp employing a low wattage, line voltage, coiled coil filament. An example of such a coiled coil would be one rated at 100 watts and 120 volts. Such a coil is formed from fine tungsten wire (12.5 mg/200 mm with a diameter of 0.0025 inches) and filament sag and short life due to the presence of the halogen would be a serious problem.

The use of halogen in an incandescent lamp generally allows for an envelope which is drastically reduced from the size that would be required by a non-halogen version of the same wattage. Specifically, the 100 watt filament described above is normally sealed in an A19 glass bulb under non-halogen conditions but can be sealed in a T5 glass envelope when halogen is added. The relative volumes of these two bulbs are:

1. A19=130 cc
2. T5=5.2 cc

The use of this drastically smaller T5 envelope provides for higher fill pressures which in turn results in a lamp performance increase. However, the filament is now significantly closer to the bulb wall of the T5 and filament sag while burning in any position other than the vertical results in the coil moving closer to the wall. The result is a local increase in bulb wall temperature with a corresponding increase in outgassing of the glass which can be deleterious to lamp performance. In the most severe case, the filament can (and has) sagged to the point where it makes contact with the bulb wall. The result is thermal cracking or melting of the bulb wall which terminates lamp life prematurely.

There are numerous techniques now in use attempting to solve the problem of sag in halogen lamps of this type. However, each one introduces new problems which forces a compromise with respect to lamp performance. Some of the more widely used techniques are briefly described here.

1. Center Support—Sag can be restricted significantly by using a third wire which loops around the center of the coil and is electrically isolated from the two end lead wires. Sag in any position except vertical will result in two catenaries whose displacement from the original coil center line is less than that of an unsupported single catenary. However, contact between coil and support results in a local cool spot which then becomes the center of increased halogen activity with its associated tungsten corrosion. The coil will utimately fail prematurely due to the accelerated thinning in the area of contact with the center support wire. Also, a center support makes lamp manufacture more difficult and costly.

2. Pre-Stabilized Coil—As previously described, this process results in less overall sag but is restricted to hand mounting due to coil embrittlement. This latter restriction results in a significant increase in manufacturing cost which is intolerable in low cost lamp types, such as would be suitable for general home illumination.

3. Methane Light Up—This is a well-known process employed during the lampe exhaust cycle whereby the filament is energized in an atmosphere of nitrogen and methane ($CH_4$). The literature alludes to reduced coil sag as a result and attributes this benefit to a reaction between the tungsten filament and the carbon in the methane. However, tests run on a 100 watt, 120 volt coil, such as that described above, resulted in absolutely no reduction in coil sag when compared with control lamps which were not lighted in methane.

4. Other Halides—The halogen additive often used is Hydrogen Bromide (HBr). It is considered by some lamp manufacturers to be too corrosive and therefore less desirable than the carbonaceous halides. Tests run fail to show any advantages to using this type of halide ($CH_2Br_2$, for example). A serious defect arises when using this gas. The result is a significant attenuation of light output which is caused by a carbon layer deposited on the inner bulb wall during initial lightup when the $CH_2Br_2$ is decomposed into a more elemental form.

5. Reduced Halogen Content—It has been shown by tests that a reduction in halogen content in the fill gas will give rise to a corresponding reduction in filament sag and corrosion. Unfortunately, it will also result in an increase in the percentage of lamps which will turn black prematurely due to failure of the halogen regnerative cycle. Lamp blackening of any halogen lamp constitutes lamp failure even if the filament continues to burn. No reputable lamp manufacturer would tolerate such a condition.

6. Condenser Discharge Flashing—This is a process which attempts to achieve the results displayed by a pre-stabilized filament while circumventing the brittle coil/hand mount problems of the latter. It involves stabilizing the filament after mounting either during the exhaust cycle or after tipoff. A condenser is used to discharge a high energy pulse through the coil. The pulse duration is very short compared to the conventional series-ballast flashing process used by many lamp manufacturers. This shorter time duration significantly reduces the heat sinking effect on the coil's metallurgical structure by the lead-in clamps. Thus, the coil is allowed to stabilize more completely in the clamp area from where much of the sag problem emanates. However, it is felt that this method will achieve, at best, only a portion of the effect desired. and that at increased cost of manufacture.

7. Low Sag Coil Design—It has been demonstrated that the coil design which exhibits the least amount of sag is one which has the tightest T.P.I. and lowest mandrel to wire (coil) ratio with respect to both the primary and secondary windings of the CC8 filament. All of this must be done, however, within the allowable limits of prescribed coil maufacturing practice. Like condenser discharge flashing, it is felt that low sag coil design will achieve only a portion of the desired effect.

Recent discoveries have shown that the addition of small quantities of copper included in such lamps will greatly reduce filament sag. These discoveries are set forth in U.S. application Ser. Nos. 372,512; 372,508; 372,519; 372,594; and 372,518, filed concurrently herewith an assigned to the assignee of the present invention.

It would be an advance in the art if other additives could be found which would reduce filament sag.

DISCLOSURE OF THE INVENTION

It is, therefore, an object of this invention to obviate the disadvantages of the prior art.

It is another object of the invention to enhance tungsten-halogen lamps.

Yet another object of the invention is to significantly reduce primary and secondary filament sag in incandescent lamps.

These objects are accomplished, in one aspect of the invention, by the provision, within a tungsten-halogen lamp, of an additive which significantly reduces filament sag. The additive is selected from the group consisting of bismuth, antimony and tellurium.

The invention allows the fabrication of halogen lamps in wattage varieties and voltage requirements suitable for replacement of the usual incandescent lamps normally used for home lighting. The lamps are characterized by the excellent lumen maintenance (percentage of light output retained from original light output as the lamps age) associated with lamps employing the halogen regenerative cycle. Excellent life ratings are also achieved regardless of the burning orientation of the lamp.

BEST MODE FOR CARRYING OUT THE INVENTION

For a better understanding of the present invention, together with other and further objects, advantages and capabilities thereof, reference is made to the following disclosure and appended claims taken in conjuction with the above-described drawings.

Figure 1:
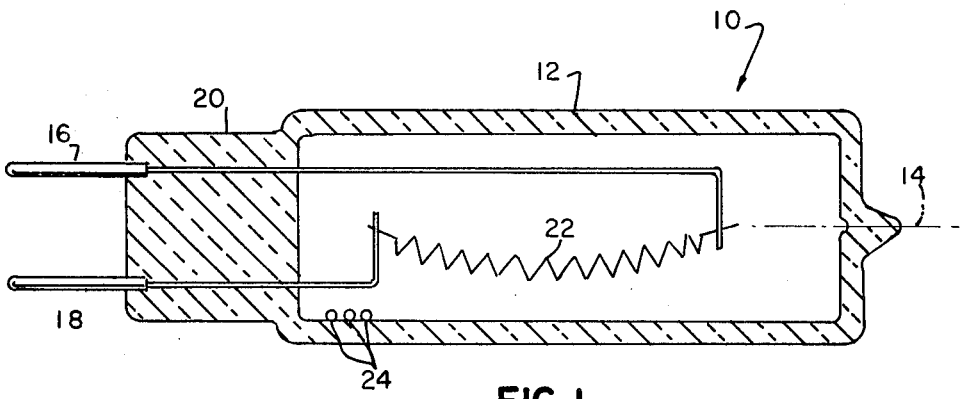
FIG. 1 is a diagrammatic, sectional view of a lamp embodying the invention.

Referring now to the drawings with greater particularity, there is shown in FIG. 1 a lamp 10 having a light transmitting, hermetically sealed glass envelope 12 of a suitable material, such as, for example, borosilicate or aluminosilicate glass.

Envelope 12 has a longitudinal axis 14 and lead-in wires 16 and 18 sealed in a press 20 and extending internally and externally of envelope 12. The lead-in wires are selected from materials that fill a relatively strain free, hermetic seal with the glass, e.g., molybdenum or alloys thereof in the case of the glasses mentioned above.

A tungsten filament 22 is attached between the internal ends of the lead-in wires 16 and 18 and extends substantially along the longitudinal axis 14.

A fill gas comprising an inert gas and a halogen at relatively high pressure is included within envelope. In a specific embodiment, envelope 12 comprised a T4 bulb (0.485" O.D.) of Corning Glass Works 1720 glass. The envelope was about 2 inches overall. Filament 22 was rated at 120 volts, 47 watts, and was mounted with 0.82 inch mounting length between lead-ins. The fill gas comprised 2% nitrogen, 0.175% hydrogen bromide, and the balance krypton at a pressure of 7 atmospheres. Included loose within the envelope 12 was a metal additive 24 selected from the group of bismuth, antimony and tellurium.

Figure 2:
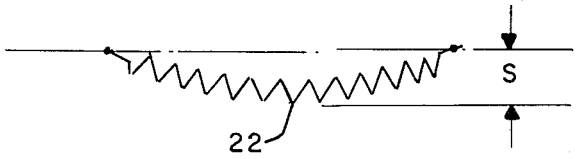
FIG. 2 is a diagrammatic view illustrating filament sag.

Results of the additive inclusion are shown in Table I taken with reference to FIG. 2.

TABLE I

| ADDITIVE | SAG (INCHES) |
|---|---|
| None (control) | 0.068 average |
| Bismuth | 0.040 |
| Antimony | 0.045 |
| Tellurium | 0.054 |

The figures were obtained by testing the lamps in a horizontal mode with the long lead-in wire 16 uppermost, as shown in FIG. 1. Initial turn on was at 120 volts; then the voltage was increased to 150 volts and held for one minute. The lamps containing metal additives employed about one cubic millimeter thereof.

The sag (S in FIG. 2) was measured as the distance from the center of the lead-ins to the lowest point on the catenary curve with the aid of an optical comparator.

As is the case with the copper additive, it is believed these additives perform their function by gettering oxygen during the early part of the lamp life.

Numerous other metals have been tried as substitutes for copper without success. Among these are tin, silver, gold, titanium, zirconium, hafnium, platinum, tantalum, lead, thallium, selenium, indium and gallium. Actually, filament sag in a thallium containing lamp was nearly double that in nonadditive control lamps.

The optimum quantity of additive would be the minimum necessary to achieve the desired results since an excess could interfere with the halogen cycle.

While there have been shown and described what are considered to be the preferred embodiments of the invention, it will be apparent to those skilled in the art that various changes and modifications can be made herein without departing from the scope of the invention as defined by the appended claims.

I claim:

1. A tungsten-halogen incandescent lamp comprising: a light transmitting, hermetically sealed glass envelope; two lead-in wires hermetically sealed in a press of said envelope and extending internally and externally thereof; a tungsen filament attached between the internal ends of said lead-in wires; a fill gas in said envelope, said fill gas comprising an inert gas and a halogen at relatively high pressure; and an effective amount of a component to reduce filament sag included within said envelope, said component being selected from the group consisting of bismuth, antimony and tellurium or combinations thereof.

2. The lamp of claim 1 wherein said effective amount is about one cubic millimeter.

* * * * *